US006115018A

United States Patent [19]

Okumura et al.

[11] Patent Number: 6,115,018

[45] Date of Patent: Sep. 5, 2000

[54] ACTIVE MATRIX LIQUID CRYSTAL DISPLAY DEVICE

[75] Inventors: Haruhiko Okumura, Fujisawa; Hisao Fujiwara, Yokohama, both of Japan

[73] Assignee: Kabushiki Kaisha Toshiba, Kawasaki, Japan

[21] Appl. No.: 08/818,942

[22] Filed: Mar. 17, 1997

[30] Foreign Application Priority Data

Mar. 26, 1996 [JP] Japan ..... 8-070137

[51] Int. Cl.[7] ..... G09G 3/36

[52] U.S. Cl. ..... 345/95; 345/92; 345/210; 345/96

[58] Field of Search ..... 345/87, 92, 94–97, 345/208–210, 58; 349/42

[56] References Cited

U.S. PATENT DOCUMENTS 5,151,805 9/1992 Takeda et al. ..... 345/94
5,457,474 10/1995 Ikeda ..... 345/92
5,526,012 6/1996 Shibahara ..... 345/92
5,724,057 3/1998 Kimura et al. ..... 345/89
5,734,453 3/1998 Takemura ..... 349/54
5,818,407 10/1998 Hori et al. ..... 345/92

*Primary Examiner*—Lun-Yi Lao
*Attorney, Agent, or Firm*—Oblon, Spivak, McClelland, Maier & Neustadt, P.C.

[57] ABSTRACT

An active matrix type liquid crystal display device wherein a correcting voltage having an absolute value larger than that of a feed-through voltage of the liquid crystal element is applied to a pixel electrode through a storage capacitor, when the liquid crystal has positive dielectric anisotropy and a positive voltage is applied to the pixel electrode, and when the liquid crystal has negative dielectric anisotropy and a negative voltage is applied to the pixel electrode. As the signal voltage value corrected through the storage capacitor can be changed depending on the signal voltage value of the previous field, a voltage to be applied to the liquid crystal can be corrected in advance to emphasize a change in a motion image.

20 Claims, 4 Drawing Sheets

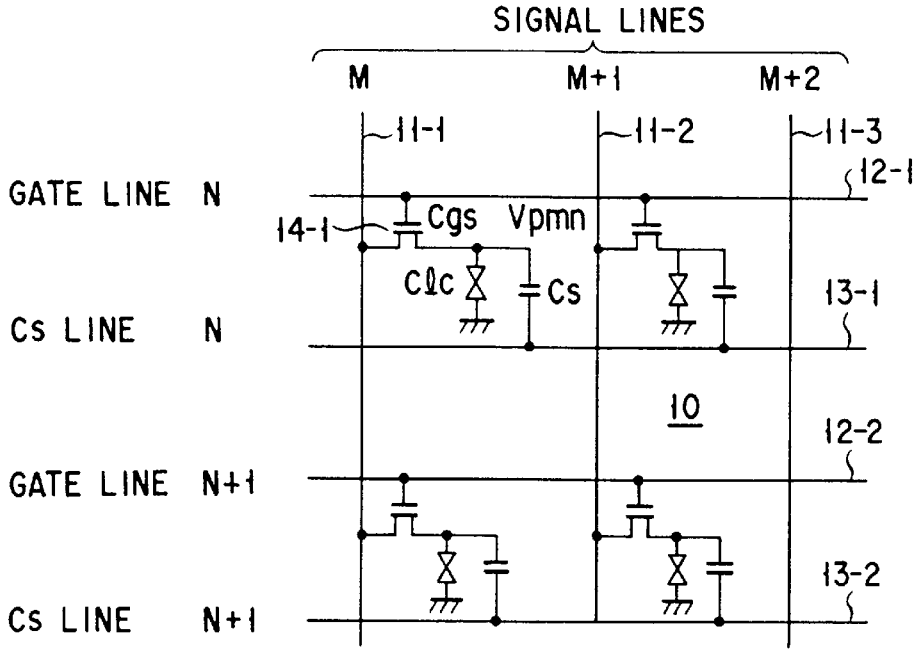
FIG. 1
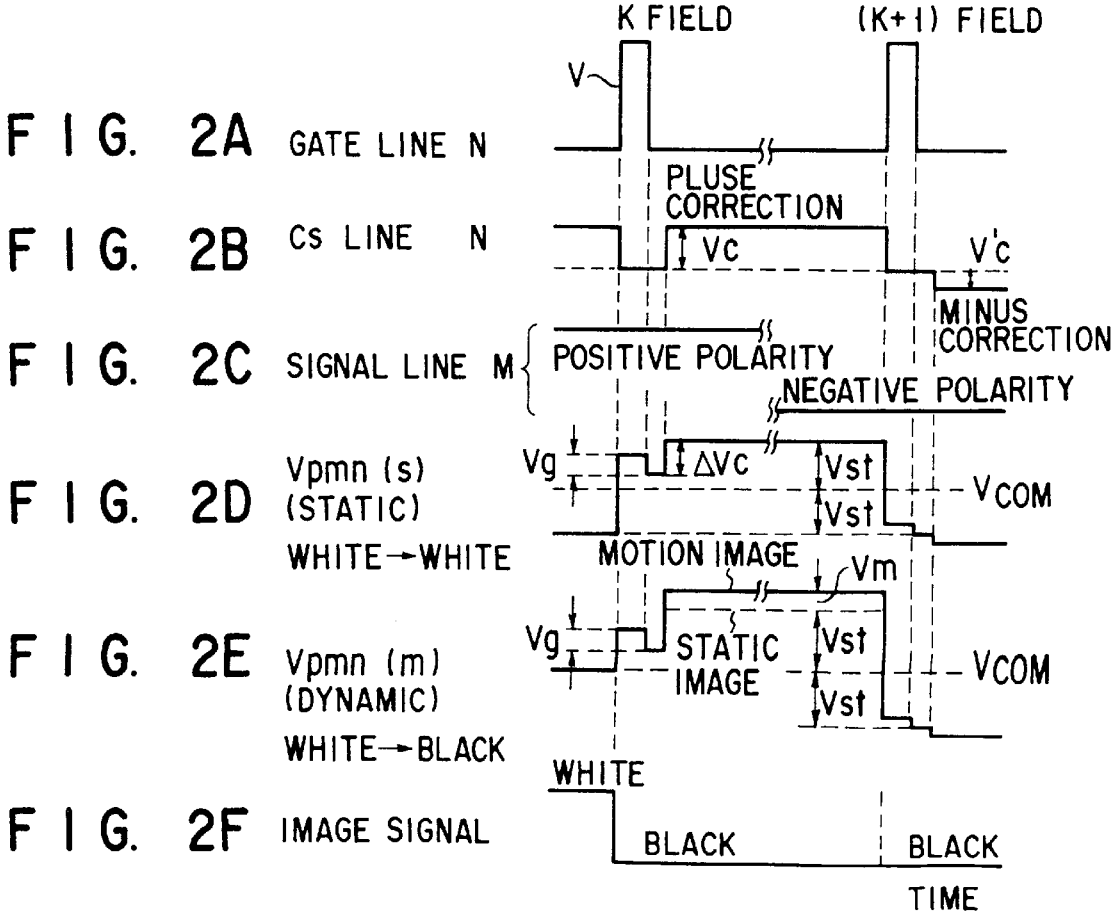

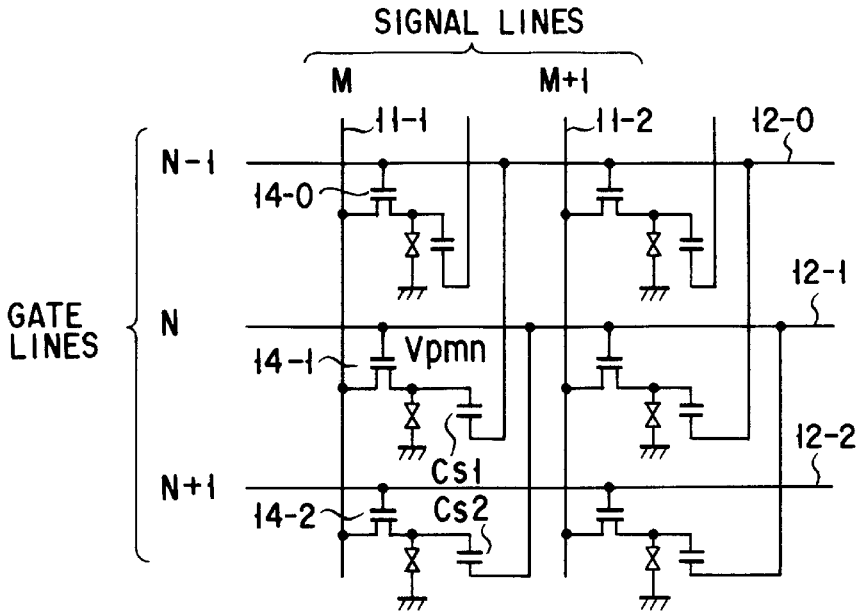
FIG. 4
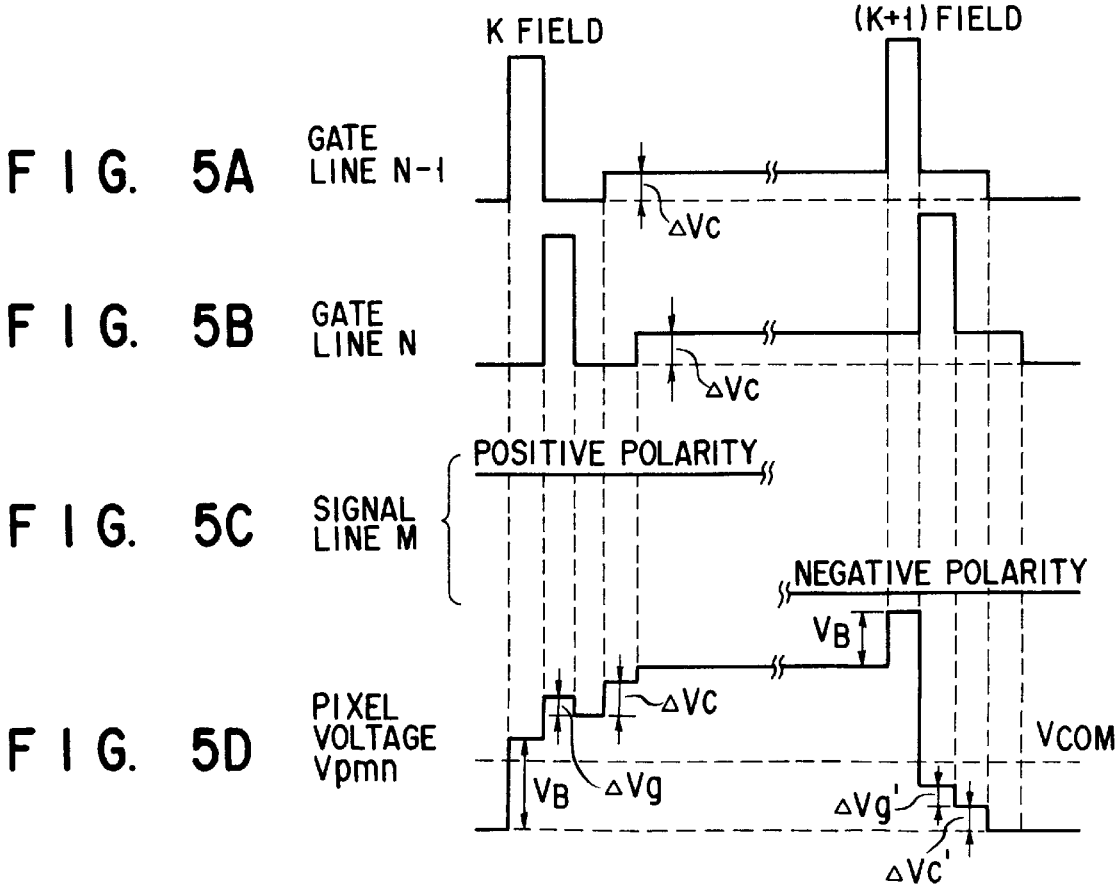
FIG. 5A
FIG. 5B
FIG. 5C
FIG. 5D

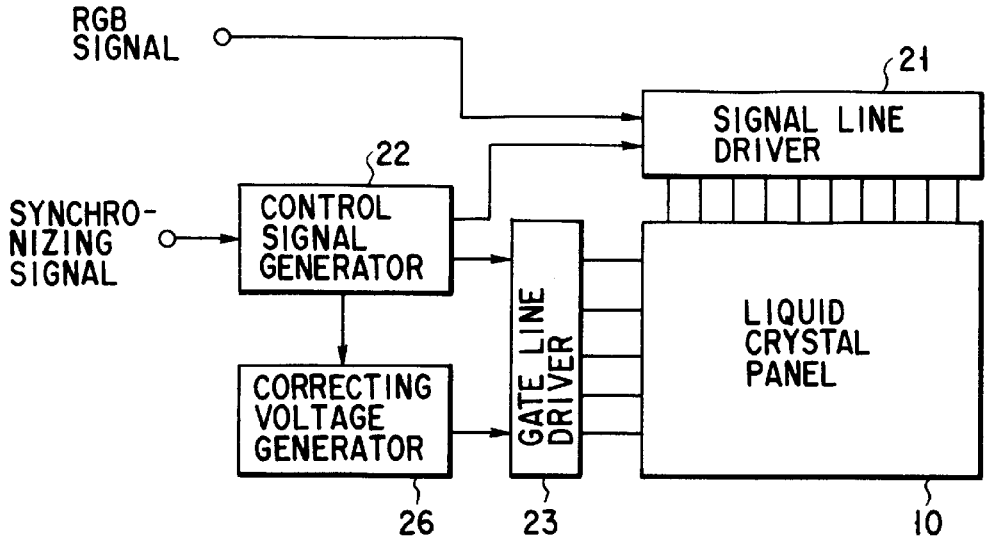
FIG. 6
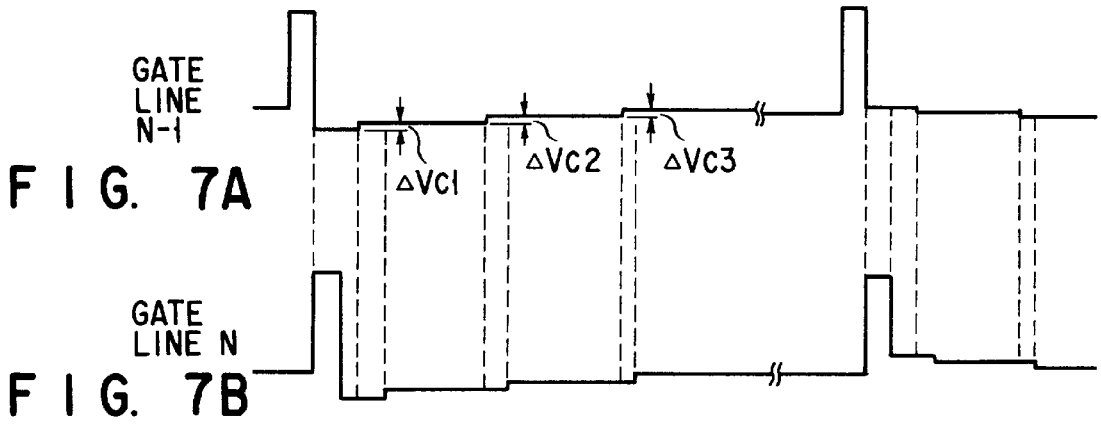
FIG. 7A
FIG. 7B

ACTIVE MATRIX LIQUID CRYSTAL DISPLAY DEVICE

BACKGROUND OF THE INVENTION

The present invention relates to an active matrix liquid crystal display device having a liquid crystal capacitor and a storage capacitor arranged parallel to the liquid crystal capacitor in units of pixels arrayed in a matrix.

In recent years, active matrix liquid crystal display devices using a TN crystal have advanced in screen size and resolution, and a high image quality is obtained for static images. For motion images, however, no satisfactory characteristics are obtained in general, though the devices are being improved by developing a fast response material or signal processing circuit.

As an improvement by signal processing, a driving method has been proposed in, e.g., Jpn. Pat. Appln. KOKAI Publication No. 4-288589 in which, for a motion image with a change in pixel potential, the voltage to be applied to the liquid crystal is corrected in advance to emphasize the change, thereby improving the image-lag characteristic of the motion image. In this driving method, R, G, and B image signals of one frame are stored in a frame memory. To detect motion of an image between two continuous frames, the difference between the image signal of one frame and that of the next frame is detected by a subtracter. This difference signal is multiplied by a predetermined coefficient $\alpha$ by a multiplier to emphasize the change. This emphasized signal is added to the current signal by an adder to obtain a change emphasized signal. This change emphasized signal is supplied to a signal line driver to drive the signal line of the liquid crystal panel. The gate line of the liquid crystal panel is driven by a gate line driver. The signal line driver and the gate line driver are controlled by the outputs from a control signal circuit which operates upon receiving a sync signal.

However, since this driving method requires, as part of the signal processing circuit, a frame memory or field memory for storing image signals of one frame, the manufacturing cost, mounting area, or power consumption undesirably increases.

BRIEF SUMMARY OF THE INVENTION

It is an object of the present invention to provide an active matrix liquid crystal display device which can omit a frame memory or field memory to reduce the cost, mounting area, and power consumption and also improve the image-lag characteristic of a motion image to obtain a high image quality.

In order to achieve the above object, according to the present invention, there is provided a liquid crystal display device comprising:

a substrate;

a plurality of gate lines extending in a row direction on the substrate and scanned in a sequential order;

a plurality of signal lines extending in a column direction on the substrate to supply a plurality of image signals;

a plurality of pixels formed at intersections of the plurality of gate lines and the plurality of signal lines, each of the plurality of pixels having a switch element having a conductive path with one end connected to a corresponding one of the plurality of signal lines, the conductive path being ON/OFF-controlled by a corresponding one of the plurality of gate lines, a liquid crystal element connected to the other end of the conductive path of the switch element and having a first electrode connected to the other end of the conductive path, a second electrode formed to oppose the first electrode, a liquid crystal inserted between the first and the second electrode, and a liquid crystal capacitor formed between the first and the second electrode, and a storage capacitor with one end connected to the first electrode of the liquid crystal element; and means for applying a correcting voltage having an absolute value larger than that of a feed-through voltage of the liquid crystal element to the first electrode through the storage capacitor, in one of cases in which the liquid crystal has positive dielectric anisotropy and a positive voltage is applied to the first electrode and in which the liquid crystal has negative dielectric anisotropy and a negative voltage is applied to the first electrode.

In the present invention, a field is formed in a cycle where all of the plurality of gate lines are scanned in a sequential order from an uppermost row, and a plurality of fields are formed by repeating the cycle, and the correcting voltage is superposed on a signal voltage of an arbitrary field of the plurality of fields to form a superposed voltage which is stored in the liquid crystal capacitor having a capacitance in a previous field of the arbitrary field and the storage capacitor belonging to the liquid crystal capacitor.

Preferably, the liquid crystal display device of the present invention further comprises a plurality of correcting signal lines extending in the row direction, and the other end of the storage capacitor is connected to a corresponding one of the plurality of correcting signal lines, and the correcting voltage is supplied from the corresponding one of the correcting signal lines.

The other end of the storage capacitor may be connected to one of the plurality of gate lines which is adjacent and previous thereto in a sequential order along the column direction, and the correcting voltage may be superposed on a corresponding one of the plurality of gate lines.

Preferably, an absolute value of a first potential of the first electrode which is applied with the correcting voltage when a corresponding one of the plurality of image signals has positive polarity substantially equals that of a second potential of the first electrode which is applied with the correcting voltage when the corresponding one of the plurality of image signals has negative polarity.

Preferably, an absolute value of a first potential of the first electrode which is applied with the correcting voltage when a corresponding one of the plurality of image signals has negative polarity is substantially larger than that of a third potential of the first electrode before correction.

Preferably, an absolute value of a second potential of the first electrode which is applied with the correcting voltage when a corresponding one of the plurality of image signals has positive polarity is substantially larger than that of a third potential of the first electrode before correction.

Preferably, the switch element is an MOS transistor.

Preferably, the correcting signal is applied to the first electrode when a corresponding one of the plurality of gate lines is selected and then shifts to a nonselected state.

The present invention is suitable for field inversion driving in which polarities of the plurality of signal lines are alternately inverted in a plurality of fields.

With the above arrangement, the value of the liquid crystal capacitor corresponding to the signal voltage value of the previous field is held to the current field. Using the fact that a signal to be actually displayed is stored as charges in the liquid crystal capacitor and the storage capacitor belonging to the liquid crystal capacitor, the signal voltage value to be corrected through the storage capacitor can be changed depending on the signal voltage value of the previous field. For this reason, for a motion image with a change in pixel voltage, a voltage to be applied to the liquid crystal can be corrected in advance to emphasize the change without using any frame memory or field memory so that high-quality display with an improved after-image characteristic can be realized.

According to the present invention, there is also provided a liquid crystal display device comprising:

a substrate;

a plurality of gate lines extending in a row direction on the substrate and scanned in a sequential order;

a plurality of signal lines extending in a column direction on the substrate to supply a plurality of image signals;

a plurality of pixels formed at intersections of the plurality of gate lines and the plurality of signal lines, each of the plurality of pixels having a switch element having a conductive path with one end connected to a corresponding one of the plurality of signal lines, the conductive path being ON/OFF-controlled by a corresponding one of the plurality of gate lines, a liquid crystal element connected to the other end of the conductive path of the switch element and having a first electrode connected to the other end of the conductive path, a second electrode formed to oppose the first electrode, a liquid crystal inserted between the first and the second electrode, and a liquid crystal capacitor formed between the first and the second electrode, and a storage capacitor with one end connected to the first electrode of the liquid crystal element; and means for applying correcting voltages having different absolute values to the first electrode through the storage capacitor, in cases in which a positive voltage is applied to the first electrode and in which a negative voltage is applied to the first electrode.

With the above arrangement, for a motion image with a change in pixel potential, a voltage to be applied to the liquid crystal can be corrected in advance to emphasize the change without using any frame memory or field memory so that high-quality display with an improved after-image characteristic can be realized.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is an equivalent circuit diagram of a liquid crystal panel according to the first embodiment of the present invention;

FIGS. 2A to 2F are timing charts showing the signal waveforms of the first embodiment;

FIG. 4 is an equivalent circuit diagram of a liquid crystal panel according to the second embodiment of the present invention;

FIGS. 5A to 5D are timing charts showing the signal waveforms of the second embodiment;

FIG. 6 is a block diagram for explaining a method of driving a liquid crystal display device according to the second embodiment; and FIGS. 7A and 7B are waveform charts showing a modification of a correcting voltage supply method in the second embodiment.

DETAILED DESCRIPTION OF THE INVENTION

Figure 3:
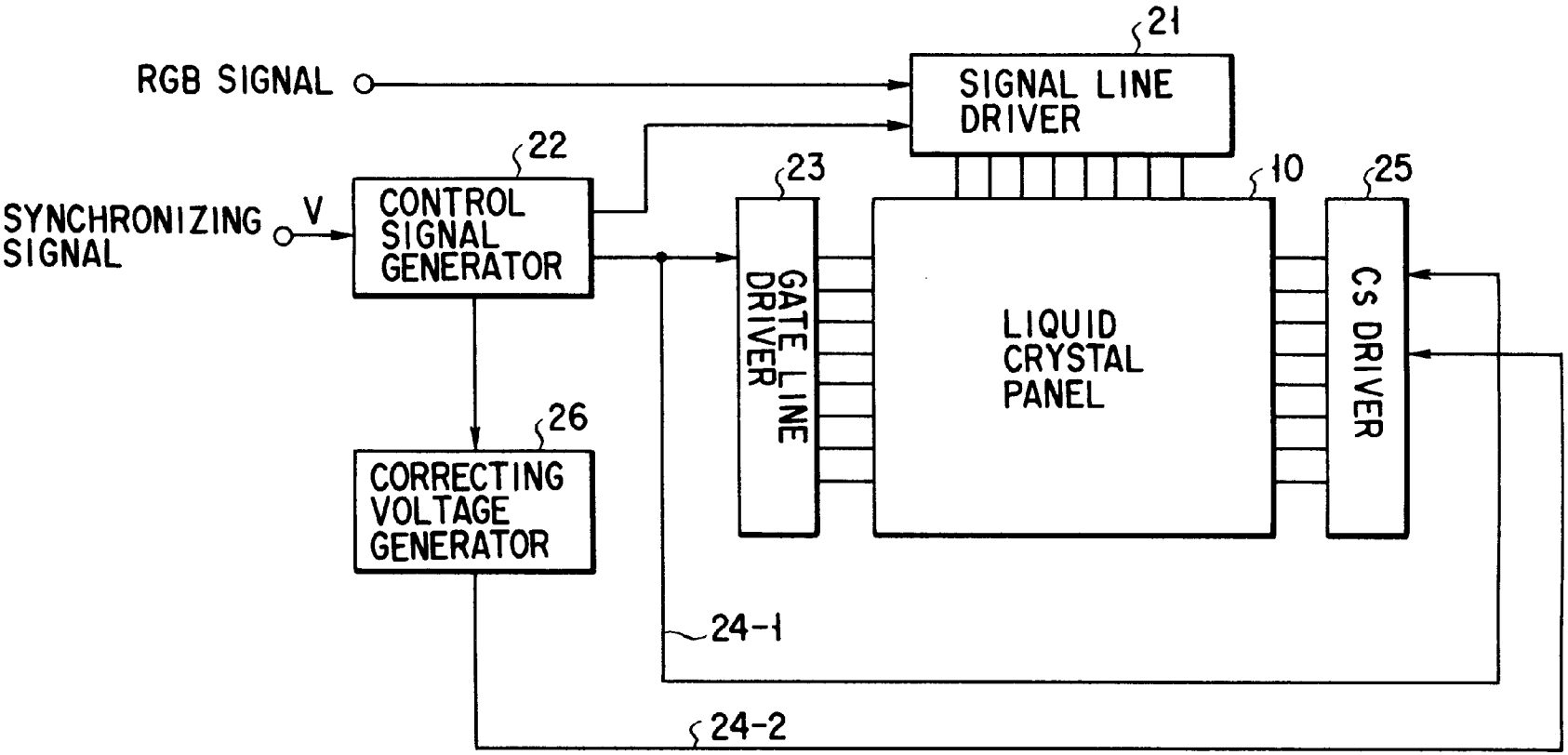
FIG. 3 is a block diagram for explaining a method of driving a liquid crystal display device according to the first embodiment.

Embodiments of the present invention will be described below with reference to the accompanying drawings.

First Embodiment

FIG. 1 is a circuit diagram of the liquid crystal panel of an active matrix liquid crystal display device according to the first embodiment of the present invention. FIG. 1 shows only some of pixels arrayed in a matrix. More specifically, Mth, (M+1)th, and (M+2)th signal lines 11-1, 11-2, and 11-3 extend in the column direction, and Nth and (N+1)th gate lines 12-1 and 12-2 and storage capacitor lines 13-1 and 13-2 belonging to these gate lines, respectively, extend in the row direction.

The gate and drain of a thin film transistor (TFT) 14-1 called a TFT switch are connected to the intersection of the Mth signal line 11-1 and the Nth gate line. The pixel electrode (not shown) of the liquid crystal element is connected to the source of the TFT. On the equivalent circuit shown in FIG. 1, the pixel electrode corresponds to one electrode of a liquid crystal capacitor Clc of the liquid crystal element. The pixel electrode is also connected to the storage capacitor line 13-1 belonging to the Nth gate line 12-1 through a storage capacitor Cs. In this case, the capacitance between the gate and source of the TFT switch 14-1 is represented by Cgs, and the pixel voltage is represented by Vpmn. A similar pixel structure including a TFT switch is formed at other intersections.

The liquid crystal display operation of the TFT switch 14-1 will be analyzed below. A feed-through voltage ΔVg generated upon turning off the TFT switch 14-1 is represented by an equation below:

$$\Delta Vg = VgCgs/(Cs+Clc+Cgs)$$

where Vg is the gate voltage of the TFT switch 14-1. As is apparent from this equation, the feed-through voltage ΔVg changes depending on the liquid crystal capacitor Clc. Normally, the dependence of the feed-through voltage on the signal voltage level poses a problem of flicker. In the present invention, however, as will be described later in detail, this factor is positively used to largely improve the image quality of a motion image.

A voltage ΔVc which is corrected through the storage capacitor Cs is given by an equation below:

$$\Delta Vc = VcCs/(Cs+Cls+Cgs)$$

where Vc is the input voltage of the correcting signal. Therefore, a change ΔVp of the pixel voltage Vpmn after correction becomes:

$$\Delta Vp = \Delta Vg + \Delta Vc$$
$$= (VgCgs + VcCs)/(Cs + Cls + Cgs)$$

A change in change ΔVp of the pixel voltage Vpmn when an image has changed between fields will be analyzed below.

1. VgCgs+VcCs<0

1-1. In case of negative polarity (1) A case in which the image changes from white to black A change ΔVpbs of a static pixel voltage Vpmn(s) of a black image is:

$$\Delta Vpbs=(VgCgs+VcCs)/(Cs+Clcb+Cgs)$$

where Clcb is the liquid crystal capacitor for the black image.

A change ΔVpbm in a motion pixel voltage Vpmn(m) of a white image is:

$$\Delta Vpbm=(VgCgs+VcCs)/(Cs+Clcw+Cgs)$$

where Clcw is the liquid crystal capacitor for the white image.

The difference between the changes of the white and black images is represented by equation (1) below:

$$\begin{aligned}\Delta Vpm\text{-}s &= \Delta Vpbm - \Delta Vpbs \\ &= (VgCgs + VcCs)/(Cs + Clcw + Cgs) - \\ &\quad (VgCgs + VcCs)/(Cs + Clcb + Cgs) \\ &= (VgCgs + VcCs)\times\{1/(Cs + Clcw + Cgs) - \\ &\quad 1/(Cs + Clcb + Cgs)\}\end{aligned} \tag{1}$$

For a liquid crystal having negative dielectric anisotropy, the following relation holds:

Clcb>Clcw

Since equation (1) is negative, the driving voltage is corrected to increase the absolute value of the driving voltage with negative polarity. That is, when the driving voltage is negative, the absolute value of the driving voltage for a motion image always becomes larger than that for a static image. This means, in a normally white mode (white without application of the driving voltage), correction to black. The driving voltage is corrected to emphasize the change from white to black.

(2) A case in which the image changes from black to white

Like the change from white to black, the difference is represented by equation (2) below:

$$\begin{aligned}\Delta Vpws &= (VgCgs + VcCs)/(Cs + Clcw + Cgs) \\ \Delta Vpwm &= (VgCgs + VcCs)/(Cs + ClCb + Cgs) \\ \Delta Vpm\text{-}s &= \Delta Vpwm - \Delta Vpws \\ &= (VgCgs + VcCs)/(Cs + Clcb + Cgs) - \\ &\quad (VgCgs + VcCs)\times 1/(Cs + Clcw + Cgs) \\ &= (VgCgs + VcCs)\times\{1/(Cs + Clcb + Cgs) - \\ &\quad 1/(Cs + Clcw + Cgs)\}\end{aligned} \tag{2}$$

For a liquid crystal having negative dielectric anisotropy, the following relation holds:

Clcb>Clcw

Since equation (2) is positive, the driving voltage is corrected to decrease the absolute value of the driving voltage with negative polarity. That is, when the driving voltage is negative, the absolute value of the driving voltage for a motion image always becomes smaller than that for a static image. This means, in the normally white mode, correction to white. The driving voltage is corrected to emphasize the change from black to white.

1-2. In case of positive polarity (1) A case in which the image changes from white to black Like equation (1), the difference is represented by equation (3) below:

$$\begin{aligned}\Delta Vpbs &= (VgCgs + VcCs)/(Cs + Clcb + Cgs) \\ \Delta Vpbm &= (VgCgs + VcCs)/(Cs + Clcw + Cgs) \\ \Delta Vpm\text{-}s &= \Delta Vpbm - \Delta Vpbs \\ &= (VgCgs + VcCs)/(Cs + Clcw + Cgs) - \\ &\quad (VgCgs + VcCs)\times 1/(Cs + Clcb + Cgs) \\ &= (VgCgs + VcCs)\times\{1/(Cs + Clcw + Cgs) - \\ &\quad 1/(Cs + Clcb + Cgs)\}\end{aligned} \tag{3}$$

For a liquid crystal having negative dielectric anisotropy, the following relation holds:

Clcb>Clcw

Since equation (3) is negative, the driving voltage is corrected to decrease the absolute value of the driving voltage with positive polarity. That is, when the driving voltage is positive, the absolute value of the driving voltage for a motion image always becomes smaller than that for a static image. This means, in the normally white mode (white without application of the driving voltage), correction to white. The driving voltage is corrected to suppress the change from white to black.

(2) A case in which the image changes from black to white

Like the change from white to black, the difference is represented by equation (4) below:

$$\begin{aligned}\Delta Vpws &= (VgCgs + VcCs)/(Cs + Clcw + Cgs) \\ \Delta Vpwm &= (VgCgs + VcCs)/(Cs + Clcb + Cgs) \\ \Delta Vpm\text{-}s &= \Delta Vpwm - \Delta Vpws \\ &= (VgCgs + VcCs)/(Cs + Clcb + Cgs) - \\ &\quad (VgCgs + VcCs)/(Cs + Clcw + Cgs) \\ &= (VgCgs + VcCs)\times\{1/(Cs + Clcb + Cgs) - \\ &\quad 1/(Cs + Clcw + Cgs)\}\end{aligned} \tag{4}$$

For a liquid crystal having negative dielectric anisotropy, the following relation holds:

Clcb>Clcw

Since equation (4) is positive, the driving voltage is corrected to increase the absolute value of the driving voltage with positive polarity. That is, when the driving voltage is positive, the absolute value of the driving voltage for a motion image always becomes larger than that for a static image. This means, in the normally white mode, correction to black. The driving voltage is corrected to suppress the image change from black to white.

2. VgCgs+VcCs≧0

2-1. In case of negative polarity (1) A case in which the image changes from white to black Similarly, equation (1) is positive. When the driving voltage is negative, the driving voltage for a motion image always becomes smaller than that for a static image. This means, in the normally white mode, correction to white. The driving voltage is corrected to suppress the image change from white to black.

(2) A case in which the image changes from black to white

Similarly, equation (2) is negative. When the driving voltage is negative, the driving voltage for a motion image always becomes smaller than that for a static image. This means, in the normally white mode, correction to black. The driving voltage is corrected to suppress the change from black to white.

2-2. In case of positive polarity (1) A case in which the image changes from white to black Similarly, equation (3) is positive. When the driving voltage is positive, the driving voltage for a motion image always becomes larger than that for a static image. This means, in the normally white mode, correction to black. The driving voltage is corrected to emphasize the change from white to black.

(2) A case in which the image changes from black to white

Similarly, equation (4) is negative. When the driving voltage is positive, the driving voltage for a motion image always becomes smaller than that for a static image. This means, in the normally white mode, correction to white. The driving voltage is corrected to emphasize the change from black to white.

As has been described above, the following facts are revealed for a liquid crystal having negative dielectric anisotropy.

(1) Driving with negative polarity

When the condition $VgCgs+VcCs>0$ (or $\leqq$) is satisfied, correction can be performed to emphasize changes in motion image.

(2) Driving with positive polarity

When the condition $VgCgs+VcCs>0$ (or $\geqq$) is satisfied, correction can be performed to emphasize changes in motion image.

Therefore, when the correcting voltage Vc is applied in accordance with the polarity of the driving voltage to satisfy the above condition, the response characteristic of the liquid crystal can be improved.

The liquid crystal having negative dielectric anisotropy has been described above. For a liquid crystal (e.g., a TN liquid crystal) having positive dielectric anisotropy, correction in the opposite direction is performed, as a matter of course.

So-called inversion driving has been described above. For a liquid crystal material which can be driven only with negative polarity, the correcting voltage Vc need not be applied because the feed-through voltage originally acts to emphasize the change (motion).

If an array structure which uses an N-channel TFT when the driving voltage is negative, and which uses a P-channel TFT when the driving voltage is positive is employed, the present invention can be practiced with such a structure because the feed-through voltage acts to emphasize the change (motion).

A method of driving the liquid crystal panel shown in FIG. 1 will be described below with reference to waveform charts in FIGS. 2A to 2F. In the K field, the Nth gate line 12-1 is selected. When the image signal has positive polarity, the image signal is written in a pixel selected by, e.g., the Mth signal line 11-1 through the TFT switch 14-1.

When the TFT switch 14-1 is turned off, the feed-through voltage ΔVg is applied to the pixel electrode through the capacitance Cgs between the gate and source (FIG. 2D). Thereafter, the correcting voltage Vc is input through the storage capacitor Cs (FIG. 2B). Since an effective correcting voltage ΔVc higher than the feed-through voltage ΔVg is applied to the pixel (FIG. 2D), the pixel voltage increases according to equation (3) or (4). Note that the correcting voltage Vc can be input at an arbitrary timing after the gate line signal disappears.

In the field one field after the K field, i.e., in the (K+1) field, when the Nth gate line 12-1 is selected, the polarity of the image signal is inverted by field inversion (FIG. 2C) so that the image signal with negative polarity is written in the pixel. Similarly, when the TFT switch 14-1 is turned off, a feed-through voltage ΔVg is generated. Thereafter, the correcting voltage Vc' is input through the storage capacitor Cs in a direction opposite to that of positive polarity. The pixel voltage decreases according to equation (1) or (2).

With the above operation, a voltage change corresponding to equations (1) to (4) can be actually realized.

The operation will be described in more detail with reference to FIGS. 1 to 3.

A signal from a signal line driver 21 shown in FIG. 3 is supplied to the signal lines 11-1, 11-2, and 11-3 of a liquid crystal panel 10 shown in FIG. 1. R, G, and B image signals are input to the signal line driver 21. The supply timing is controlled by a control signal generator 22 which operates in accordance with a field sync signal V. A gate line driver 23 is driven in accordance with the field sync signal V input to the control signal generator 22 to supply, to the Nth gate line 12-1, a scan signal which rises at the beginning of each field period, as shown in FIG. 2A. FIG. 2A shows only the K and (K+1) fields. In this embodiment, field inversion for inverting the polarity of the driving voltage to the liquid crystal for every field is employed. Therefore, for the period of the K field, a signal voltage with positive polarity is applied to the Mth signal line 11-1, and for the period of the (K+1) field, a signal voltage with negative polarity is applied to the Mth signal line 11-1, as shown in FIG. 2C.

A signal indicating the field start timing is supplied from the control signal generator 22 to a Cs driver 25 through a line 24-1. Simultaneously, a correction signal shown in FIG. 2B is supplied, to the Cs driver 25 through a line 24-2, from a correcting voltage generator which is controlled by the control signal generator 22. For driving with positive polarity in the K field, a correcting voltage with positive polarity is applied to the Cs line 13-1, and for driving with negative polarity in the (K+1) field, a correcting voltage with negative polarity is applied to the Cs line 13-1, as shown in FIG. 2B.

This example assumes that the image signal changes from white to black in the K field and remains black in the (K+1) field, as shown in FIG. 2F. The pixel voltage changes to the black state at the beginning of the K field. However, the liquid crystal capacitor remains in the white state because it cannot immediately respond. Since the liquid crystal capacitor in the white state is small, the correcting voltage value becomes large. This is why the magnitude of the correcting voltage Vc in the K field is different from that of the correcting voltage Vc' in the (K+1) field.

In a static image display mode in which a white image is displayed in the (K+1) field, and a white image is displayed in the K field as well, unlike the above example, the static pixel voltage Vpmn(s) changes in the plus and minus directions with respect to a common voltage Vcom by a same level difference Vst, as shown in FIG. 2D. This also applies to the shift from the K field to the (K+1) field (shift from black to black) in FIG. 2F.

When a white image is displayed in the (K−1) field, and a black image is displayed in the K field, as shown in FIG.

2F, i.e., in a motion image display mode, a voltage obtained by adding a motion image voltage Vm to the voltage Vst in the static image display mode in the plus direction with respect to the common voltage Vcom is applied in the K field as the motion pixel voltage Vpmn(m), as shown in FIG. 2E. In the minus direction in the (K+1) field, the level difference voltage Vst which is the same as that in the static image display mode is applied because the image remains black. As described above, in driving with a driving voltage of positive polarity, the voltage in the motion image display mode always becomes larger than that in the static image display mode, so that a voltage for emphasizing the change is generated from a correcting voltage generator 26.

Second Embodiment

The second embodiment of the present invention will be described below with reference to FIGS. 4 to 6. The same reference numerals as in FIGS. 1 to 3 denote the same parts in FIGS. 4 to 6, and a detailed description thereof will be omitted.

In this embodiment, a gate line is also used as the storage capacitor line of the next gate line, instead of using storage capacitor lines 13-1 and 13-2 of the first embodiment. This array structure has a so-called Cs on gate structure. As shown in the equivalent circuit in FIG. 4, a storage capacitor Cs1 connected to a TFT 14-1 is connected, in turn, to an (N−1)th gate line 12-1 adjacent to an Nth gate line 12-1, and a storage capacitor Cs2 connected to a TFT 14-2 connected to an (N+1)th gate line 12-2 is, in turn, connected to the adjacent Nth gate line 12-1.

FIG. 6 shows the overall circuit arrangement. A storage capacitor (Cs) driver 25 in FIG. 3 is omitted. To drive the gate line by a gate line driver 23 in conjunction with a correcting voltage, the output from a correcting voltage generator 26 is supplied to the gate line driver 23.

The operation of the second embodiment will be described below with reference to FIGS. 5A to 5D. In the K field, an output from the gate line driver 23 is supplied to the (N−1)th gate line 12-0 at a timing shown in FIG. 5A to select the (N−1)th gate line 12-0. The (N-l)th gate line shifts to the nonselected state after a predetermined period of time. At the same time, an output from the gate line driver 23 is supplied to the Nth gate line 12-1 at a timing shown in FIG. 5B to select the Nth gate line 12-1. In this state, an Mth signal line 11-1 has positive polarity, as shown in FIG. 5C.

After the Nth gate line 12-1 is selected and subsequently shifts to the nonselected state, a correcting signal ΔVc is superposed on the (N−1)th gate line 12-0 connected to the storage capacitor Cs1, as shown in FIG. 5A.

In the (K+1) field, an inverted voltage with negative polarity is applied to the Mth signal line, as shown in FIG. 5C. As in the K field, an output from the gate line driver 23 is supplied to the (N−1)th gate line 12-0 at the timing shown in FIG. 5A to select the (N−1)th gate line 12-0. The (N−1)th gate line shifts to the nonselected state after a predetermined period of time. At the same time, an output from the gate line driver 23 is supplied to the Nth gate line 12-1 at the timing shown in FIG. 5B to select the Nth gate line 12-1. As described above, the Mth signal line 11-1 has negative polarity in this state, as shown in FIG. 5C.

After the Nth gate line 12-1 is selected and subsequently shifts to the nonselected state, application of the correcting signal ΔVc to the (N−1)th gate line 12-0 connected to the storage capacitor Cs1 is stopped, as shown in FIG. 5A.

FIG. 5D shows the waveform of a pixel voltage Vpmn of a liquid crystal capacitor connected to the TFT switch 14-1. Before the scanning is started in the K field, a voltage VB in the previous field is applied to the pixel electrode connected to the gate line 12-1. When the (N−1)th gate line 12-0 is selected to turn on the switch 14-0, a feed-through voltage VB is applied to the pixel electrode connected to the gate line 12-1 through Cs1. After that, when the Nth gate line 12-1 is selected to turn on the switch 14-1, a signal supplied from the Mth signal line 11-1 is applied to the pixel electrode. When the switch 14-1 is turned off, a feed-through voltage ΔVg is generated to slightly lower the pixel voltage Vpmn. Thereafter, a correcting voltage ΔVc higher than the feed-through voltage ΔVg and supplied from the (N−1)th gate line is applied to the pixel electrode through the storage capacitor Cs1.

In the (K+1) field, the Nth gate line 12-1 is selected, a negative polarity pixel voltage is applied and then the Nth gate line 12-1 shifts to the nonselected state. Thereafter, a correcting signal ΔVc' as shown in FIG. 5D is applied to the pixel electrode on the basis of the voltage change of the (N−1)th gate line 12-0 connected to the storage capacitor Cs1.

In this manner, the pixel voltage can be corrected according to equations (1) to (4), as in the first embodiment.

In the second embodiment, after the correcting voltage ΔVc rises, the voltage is kept at a predetermined level over one field period, as shown in FIGS. 5A and 5B. However, as shown in FIGS. 7A and 7B, the field period may be divided into a plurality of subperiods, and the correcting voltage ΔVc may be changed stepwise to divided voltages ΔVc1, ΔVc2, and ΔVc3 for the respective subperiods. By gradually changing the correcting voltage, the correcting voltage can be weighted by a predetermined amount so that the correction curve can be made closer to an optimum value. Instead of changing the correcting voltage stepwise, the correcting voltage can be changed in accordance with the waveform of a triangular wave or saw tooth wave depending on the shape of the optimum correction curve.

As has been described above, according to the present invention, a change in image signal can be detected without using any additional memory such as a frame memory or field memory. In addition, the pixel voltage can be optimally corrected in accordance with the dielectric characteristic or driving polarity of the liquid crystal to improve the image-lag characteristic. Therefore, an active matrix liquid crystal display device capable of reducing the mounting area, power consumption, and cost and displaying a high-quality image can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A liquid crystal display device comprising:

a substrate;

a plurality of gate lines extending in a row direction on said substrate and scanned in a sequential order;

a plurality of signal lines extending in a column direction on said substrate to supply a plurality of image signals;

a plurality of pixels formed at intersections of said plurality of gate lines and said plurality of signal lines, each of said plurality of pixels having a switch element having a conductive path with one end connected to a corresponding one of said plurality of signal lines, said conductive path being ON/OFF-controlled by a corresponding one of said plurality of gate lines, a liquid crystal element connected to the other end of said conductive path of said switch element and having a first electrode connected to the other end of said conductive path, a second electrode formed to oppose said first electrode, a liquid crystal inserted between said first and said second electrode, and a liquid crystal capacitor formed between said first and said second electrode, and a storage capacitor with one end connected to said first electrode of said liquid crystal element; and means for applying a correcting voltage having an absolute value larger than that of a feed-through voltage of said liquid crystal element to said first electrode through said storage capacitor, in one of cases in which said liquid crystal has positive dielectric anisotropy and a positive voltage is applied to said first electrode and in which said liquid crystal has negative dielectric anisotropy and a negative voltage is applied to said first electrode.

2. A device according to claim 1, wherein a field is formed in a cycle where all of said plurality of gate lines are scanned in a sequential order from an uppermost row, and a plurality of fields are formed by repeating the cycle, and said correcting voltage is superposed on a signal voltage of an arbitrary field of said plurality of fields to form a superposed voltage which is stored in said liquid crystal capacitor having a capacitance in a previous field of said arbitrary field and said storage capacitor belonging to said liquid crystal capacitor.

3. A device according to claim 1, further comprising a plurality of correcting signal lines extending in the row direction, and wherein the other end of said storage capacitor is connected to a corresponding one of said plurality of correcting signal lines, and said correcting voltage is supplied from said corresponding one of said correcting signal lines.

4. A device according to claim 1, wherein the other end of said storage capacitor is connected to one of said plurality of gate lines which is adjacent and previous thereto in a sequential order along the column direction, and the correcting voltage is superposed on a corresponding one of said plurality of gate lines.

5. A device according to claim 1, wherein an absolute value of a first potential of said first electrode which is applied with said correcting voltage when a corresponding one of said plurality of image signals has positive polarity substantially equals that of a second potential of said first electrode which is applied with said correcting voltage when said corresponding one of said plurality of image signals has negative polarity.

6. A device according to claim 1, wherein an absolute value of a first potential of said first electrode which is applied with said correcting voltage when a corresponding one of said plurality of image signals has positive polarity is substantially larger than that of a third potential of said first electrode before correction.

7. A device according to claim 1, wherein an absolute value of a second potential of said first electrode which is applied with said correcting voltage when a corresponding one of said plurality of image signals has negative polarity is substantially larger than that of a third potential of said first electrode before correction.

8. A device according to claim 1, wherein said switch element is an MOS transistor.

9. A device according to claim 1, wherein said correcting signal is applied to said first electrode when a corresponding one of said plurality of gate lines is selected and then shifts to a nonselected state.

10. A device according to claim 1, wherein polarities of said plurality of signal lines are alternately inverted in a plurality of fields.

11. A liquid crystal display device comprising:

a substrate;

a plurality of gate lines extending in a row direction on said substrate and scanned in a sequential order;

a plurality of signal lines extending in a column direction on said substrate to supply a plurality of image signals;

a plurality of pixels formed at intersections of said plurality of gate lines and said plurality of signal lines, each of said plurality of pixels having a switch element having a conductive path with one end connected to a corresponding one of said plurality of signal lines, said conductive path being ON/OFF-controlled by a corresponding one of said plurality of gate lines, a liquid crystal element connected to the other end of said conductive path of said switch element and having a first electrode connected to the other end of said conductive path, a second electrode formed to oppose said first electrode, a liquid crystal inserted between said first and said second electrode, and a liquid crystal capacitor formed between said first and said second electrode, and a storage capacitor with one end connected to said first electrode of said liquid crystal element; and means for applying correcting voltages having different absolute values to said first electrode through said storage capacitor, in cases in which a positive voltage is applied to said first electrode and in which a negative voltage is applied to said first electrode.

12. A device according to claim 11, wherein a field is formed in a cycle where all of said plurality of gate lines are scanned in a sequential order from an uppermost row, and a plurality of fields are formed by repeating the cycle, and each of said correcting voltages is superposed on a signal voltage of an arbitrary field of said plurality of fields to form a superposed voltage which is stored in said liquid crystal capacitor having a capacitance in a previous field of said arbitrary field and said storage capacitor belonging to said liquid crystal capacitor.

13. A device according to claim 11, further comprising a plurality of correcting signal lines extending in the row direction, and wherein the other end of said storage capacitor is connected to a corresponding one of said plurality of correcting signal lines, and each of said correcting voltages is supplied from said corresponding one of said correcting signal lines.

14. A device according to claim 11, wherein the other end of said storage capacitor is connected to one of said plurality of gate lines which is adjacent to a previous sequence of the sequential order along the column direction, and each of said correcting voltages is superposed on a corresponding one of said plurality of gate lines.

15. A device according to claim 11, wherein an absolute value of a first potential of said first electrode which is applied with one of said correcting voltages when a corresponding one of said plurality of image signals has positive polarity substantially equals that of a second potential of said first electrode which is applied with another of said correcting voltages when the corresponding one of said plurality of image signals has negative polarity.

16. A device according to claim 11, wherein an absolute value of a first potential of said first electrode which is applied with one of said correcting voltages when a corresponding one of said plurality of image signals has positive polarity is substantially larger than that of a third potential of said first electrode before correction.

17. A device according to claim 11, wherein an absolute value of a second potential of said first electrode which is applied with one of said correcting voltages when a corresponding one of said plurality of image signals has negative polarity is substantially larger than that of a third potential of said first electrode before correction.

18. A device according to claim 11, wherein said switch element is an MOS transistor.

19. A device according to claim 11, wherein each of said correcting voltages is applied to said first electrode when a corresponding one of said plurality of gate lines is selected and then shifts to a nonselected state.

20. A device according to claim 11, wherein polarities of said plurality of signal lines are alternately inverted in a plurality of fields.

* * * * *